US007638741B2

(12) United States Patent
Morgan et al.

(10) Patent No.: US 7,638,741 B2
(45) Date of Patent: Dec. 29, 2009

(54) HEAT CONDUCTOR FOR PUMP SYSTEM

(75) Inventors: Donald E. Morgan, Florissant, MO (US); Bret S. Clark, St. Louis, MO (US); Earnest R. Watkins, Webster Groves, MO (US)

(73) Assignee: Emerson Electric Co., St. Louis, MO (US)

( * ) Notice: Subject to any disclaimer, the term of this patent is extended or adjusted under 35 U.S.C. 154(b) by 222 days.

(21) Appl. No.: 11/420,598

(22) Filed: May 26, 2006

(65) Prior Publication Data

US 2007/0273222 A1 Nov. 29, 2007

(51) Int. Cl.
*H05B 3/58* (2006.01)
*H02K 1/32* (2006.01)

(52) U.S. Cl. ..... 219/535; 219/536; 310/64; 310/58; 310/52; 310/54; 417/366; 417/367; 417/370; 417/371; 417/423.8; 165/104.13; 165/104.21

(58) Field of Classification Search ..... 219/535–6; 310/64, 58, 52, 54; 417/366, 367, 370–1, 417/423.8; 165/104.13, 104.21
See application file for complete search history.

(56) References Cited

U.S. PATENT DOCUMENTS

| | | | | |
|---|---|---|---|---|
| 4,908,757 | A | 3/1990 | Jensen et al. | |
| 5,202,596 | A | 4/1993 | Jensen et al. | |
| 6,322,332 | B1 | 11/2001 | Jensen et al. | |
| 2006/0104840 | A1 * | 5/2006 | Queirel | 417/423.1 |

FOREIGN PATENT DOCUMENTS

| | | | |
|---|---|---|---|
| EP | 0 456 169 | B1 | 11/1991 |
| EP | 0 456 170 | B2 | 11/1991 |

* cited by examiner

*Primary Examiner*—Shawntina Fuqua
(74) *Attorney, Agent, or Firm*—Senniger Powers LLP

(57) ABSTRACT

A thermal conductor for a heat-generating liquid pump system of a pool containing liquid and including a pipe. The conductor is adapted for conducting heat from the pump system to liquid circulated by the pump system. The conductor includes a body in thermal communication with a heat generating portion of the pump system and in thermal communication with only an outside surface of the pipe and not in direct contact with the liquid.

23 Claims, 7 Drawing Sheets

HEAT CONDUCTOR FOR PUMP SYSTEM

FIELD OF THE INVENTION

The invention is generally related to liquid cooling of pump systems and more particularly to liquid cooling of heat-generating components of pump systems.

BACKGROUND OF THE INVENTION

Conventional whirlpools (including hot tubs, spas, Jacuzzi® baths and the like, mounted inside or outside) have water pumping systems for circulating water around the user. These pumping systems include motors, electronics and similar components that generate heat. In the past, such heat has been dissipated simply by air cooling. However, as more features are added to whirlpools, e.g., variable speed and more powerful motors and pumps, more heat is generated by the pumping systems. Moreover, these components are often located under and around the whirlpool where there is limited space and air circulation. This space now tends to include more insulation, which further limits the space and holds in the heat. Accordingly, a reliable, cost-efficient way of dissipating this increased heat, especially in the limited space adjacent the whirlpool, is needed.

SUMMARY OF THE INVENTION

One aspect is directed to a thermal conductor for a heat-generating liquid pump system of a pool containing liquid and including a pipe. The conductor being adapted for conducting heat from the pump system to liquid circulated by the pump system. The conductor comprises a body in thermal communication with a heat generating portion of the pump system and in thermal communication with only an outside surface of the pipe and not in direct contact with the liquid.

Another aspect is directed to a pool for containing water. The pool comprises a pipe system connected to the pool and including an inlet for receiving water from the pool and an outlet for forcing water back into the pool. A pump system includes a motor for circulating the water through the pipe system. The motor includes heat-generating electronics. A heat conductor is adapted for conducting heat from the electronics to the water in the pipe system.

BRIEF DESCRIPTION OF THE DRAWINGS

Corresponding reference characters indicate corresponding parts throughout the drawings.

DETAILED DESCRIPTION OF THE DRAWINGS

Figure 1:
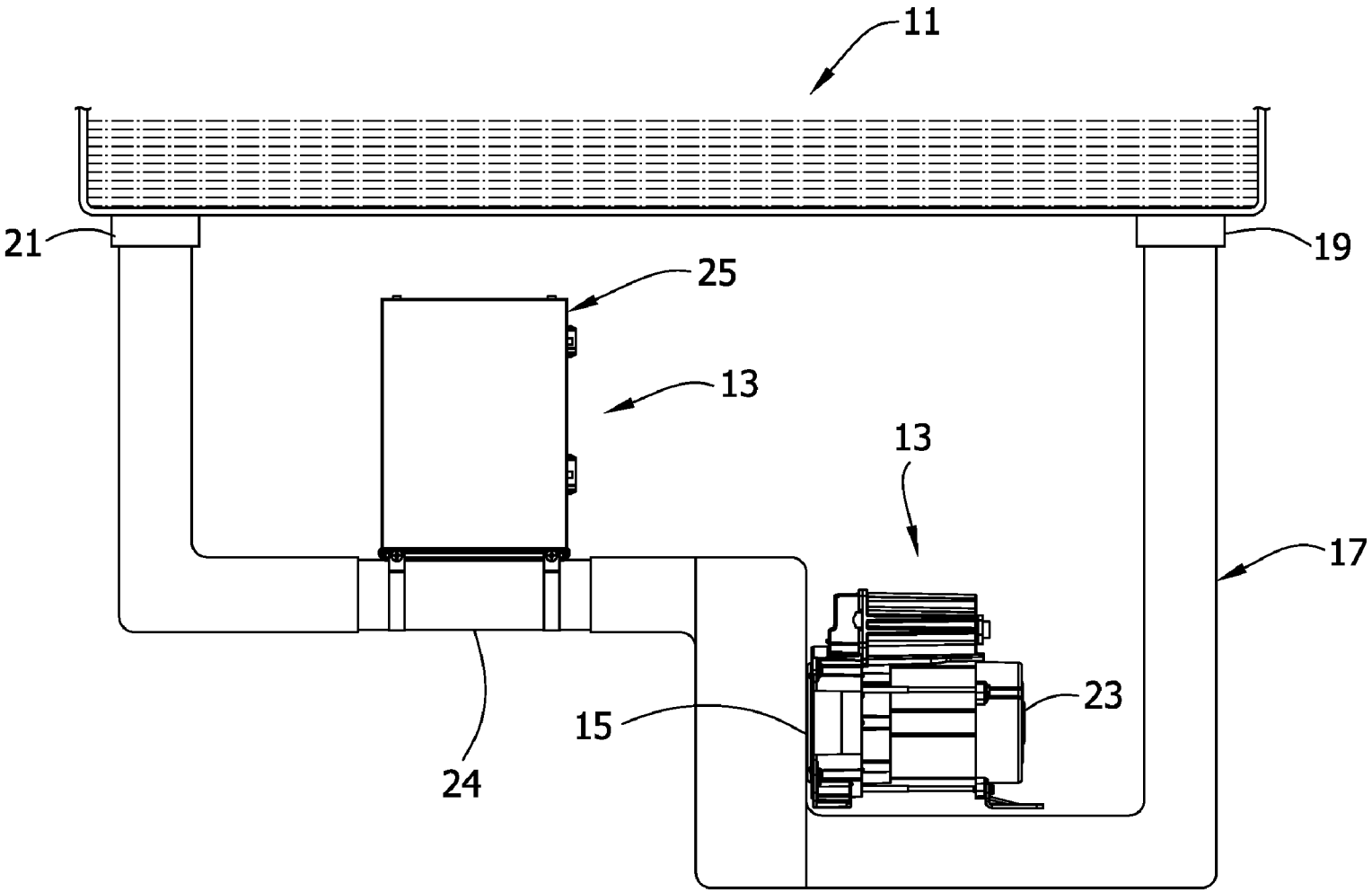
FIG. 1 is a partially schematic front view of a portion of a whirlpool bathtub and pump system of one embodiment.

Referring to the embodiment of FIG. 1, a whirlpool bathtub 11 (more generally, a pool) with pump system 13 is shown in partial schematic. The tub 11 and pump system 13 are depicted in simplified form for ease of illustration. This invention may be used with a variety of applications, including but not limited to hot tubs, spas, Jacuzzi® baths and other pools containing circulating water. Further, the system may circulate other fluids within the scope of this invention.

The pump system 13 of this embodiment generally includes a pump 15 and a pipe system 17 generally forming a passageway from an inlet 19 to an outlet 21 to the tub 11. The pump system 13 also includes a motor 23 electrically connected to a motor drive 25. In some embodiments, the motor 23 may be a variable speed motor. Generally, the pump 15 pulls water from one or more inlets 19 through the pipes 17 and forces the water back into the tub through one or more outlets 21 (e.g., jets, nozzles or the like). The pipes of the system 17 may be made of various materials, though in this embodiment most are PVC, and the section of pipe 24 adjacent the module is made of stainless steel.

Figure 2:
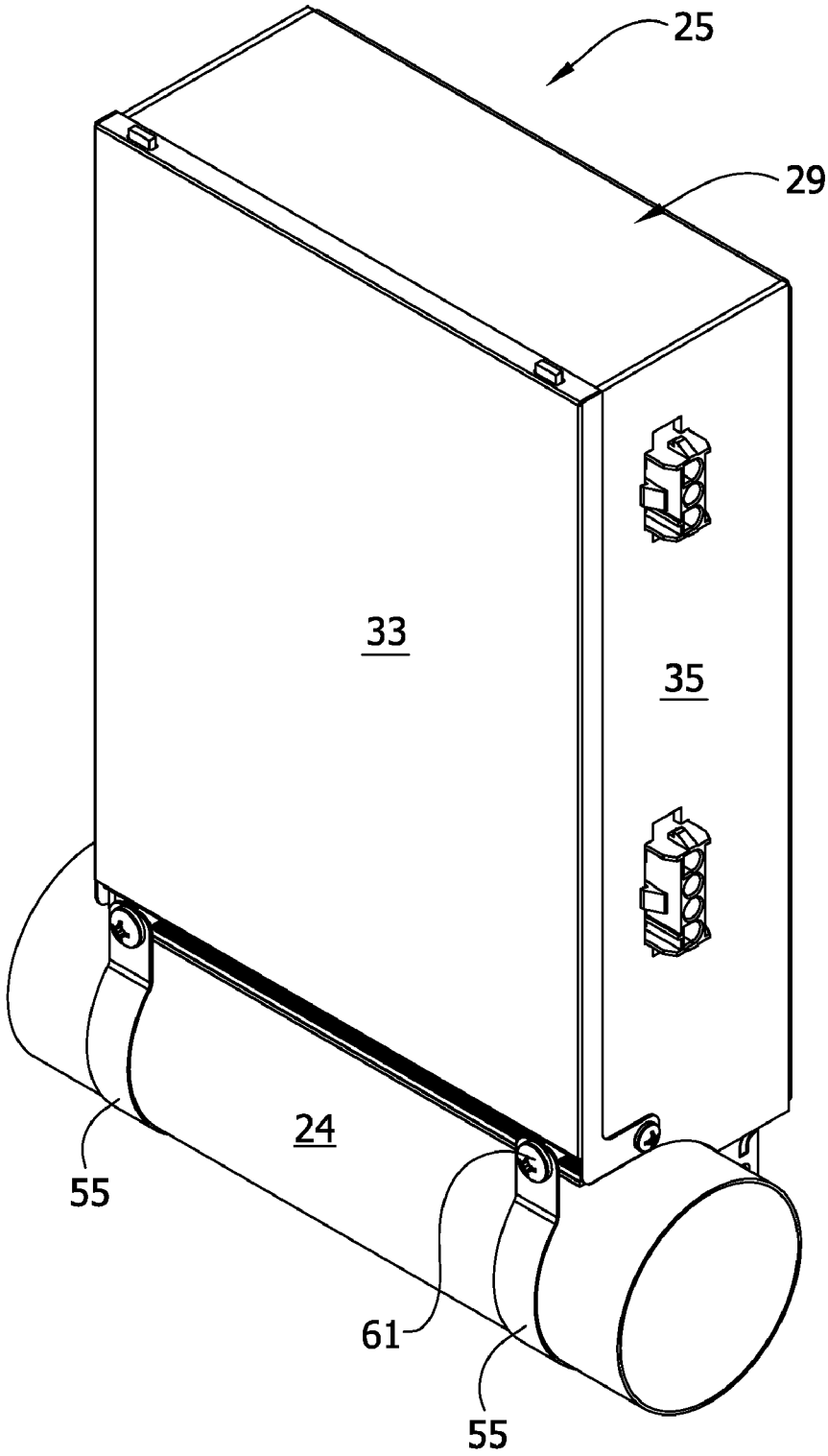
FIG. 2 is a perspective view of a motor drive housing and a pipe of the pump system.
Figure 3:
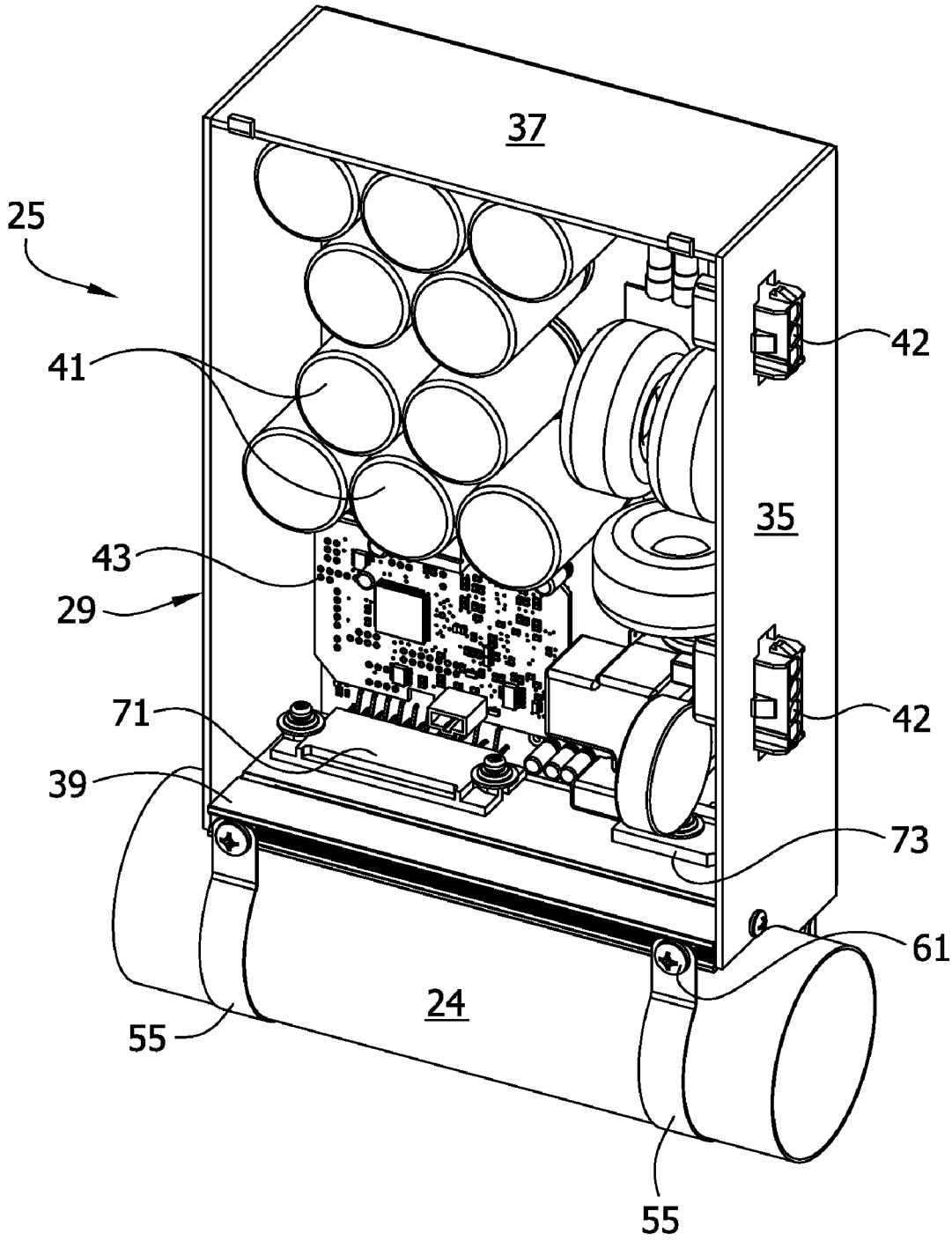
FIG. 3 is a perspective view like FIG. 2 but with the cover of the housing removed.
Figure 4:
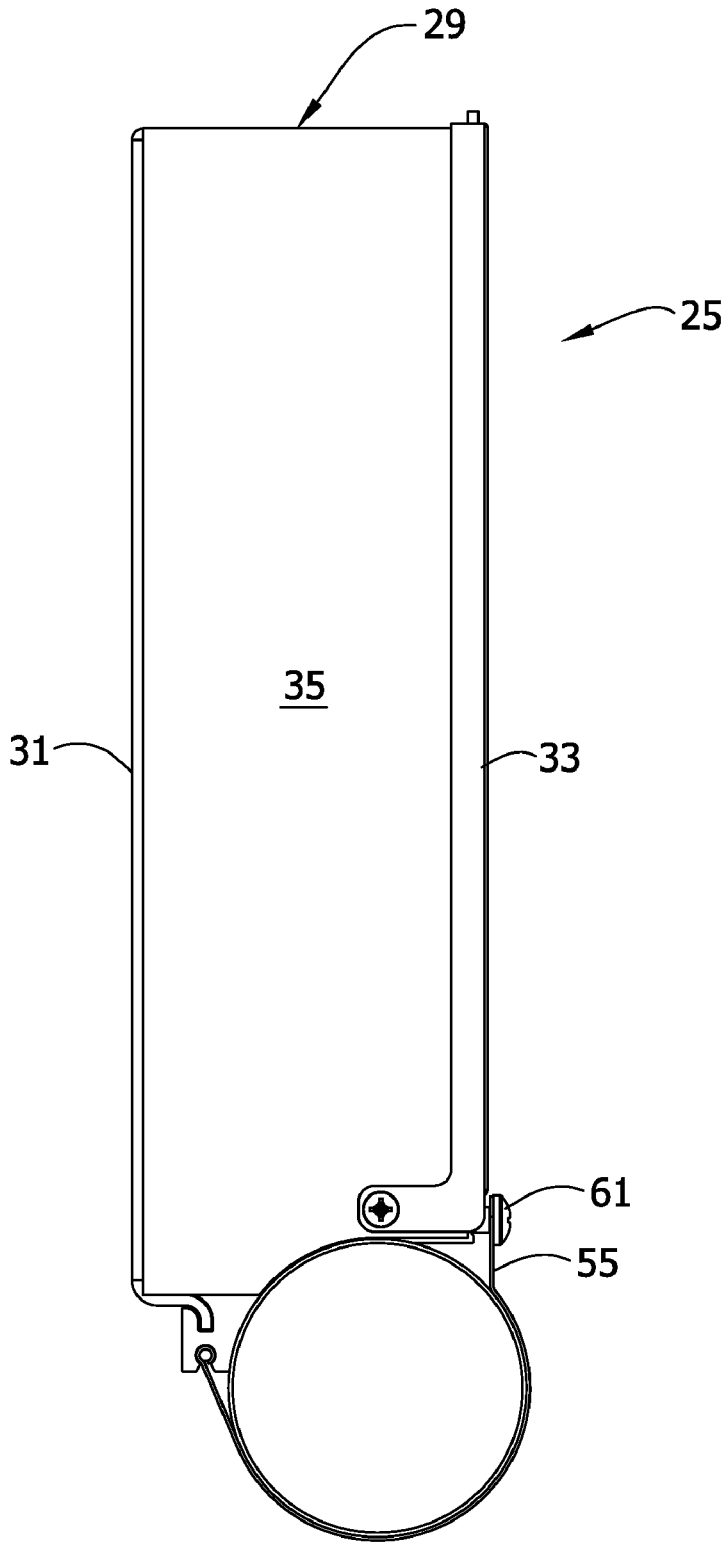
FIG. 4 is a side view of the housing.
Figure 5:
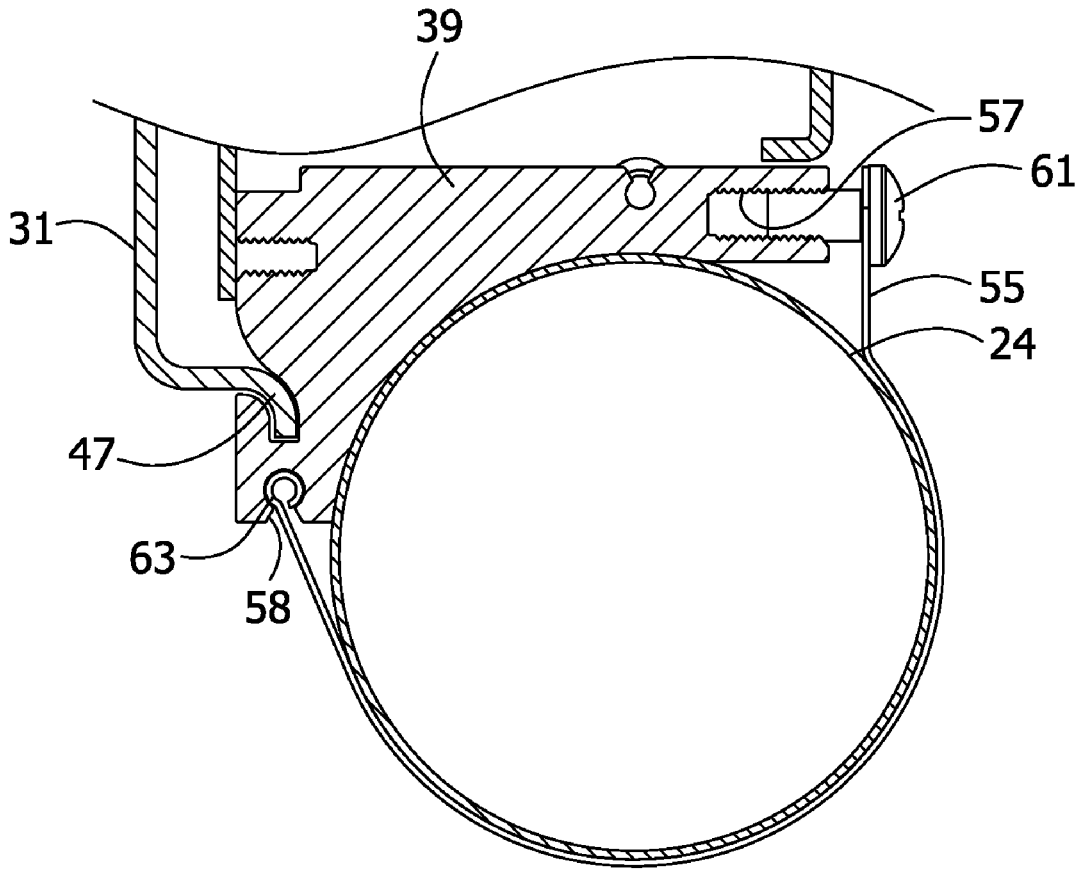
FIG. 5 is a section view of a heat conductor of one embodiment and the pipe.
Figure 6:
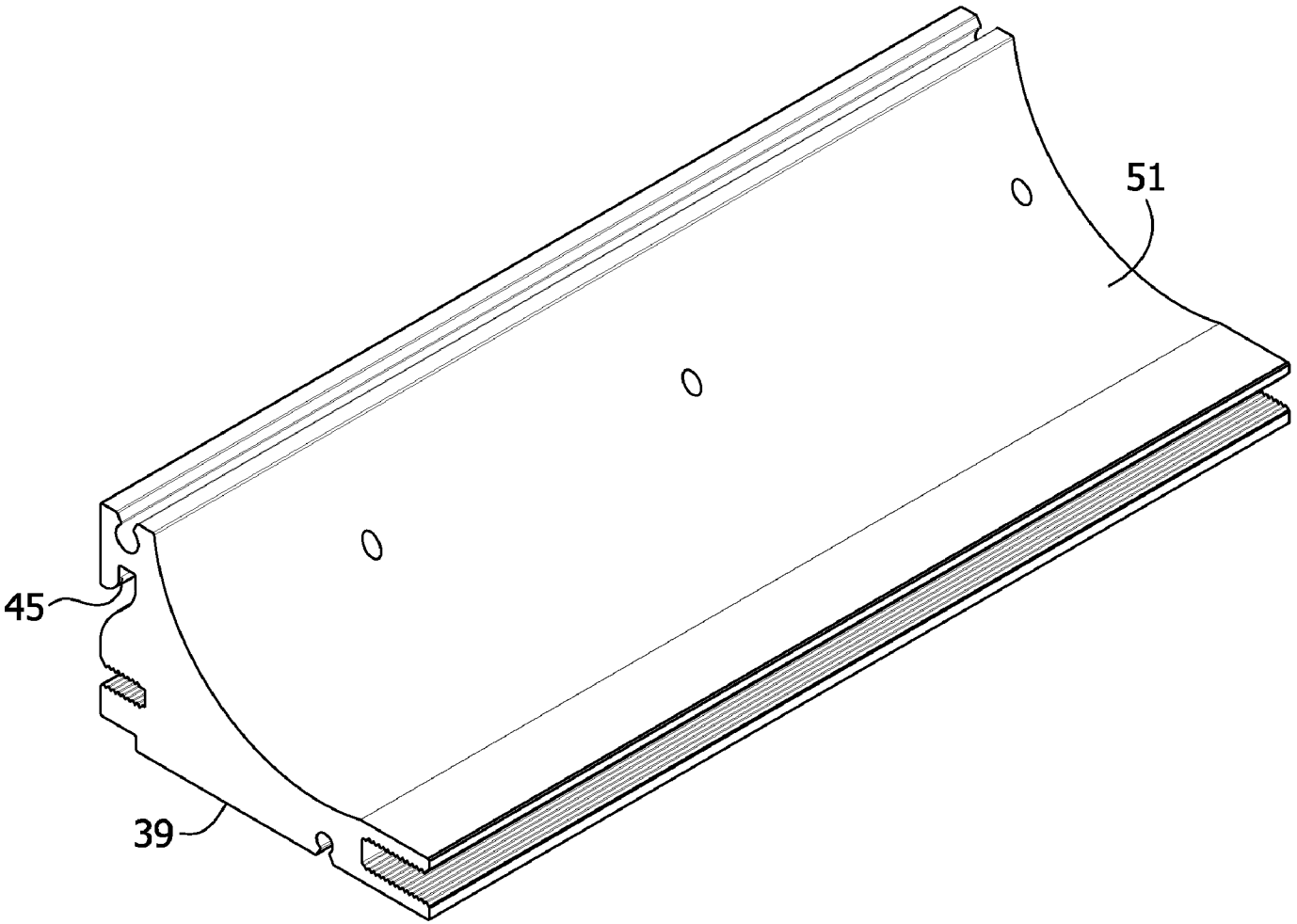
FIG. 6 is a perspective view of the heat conductor.
Figure 7:
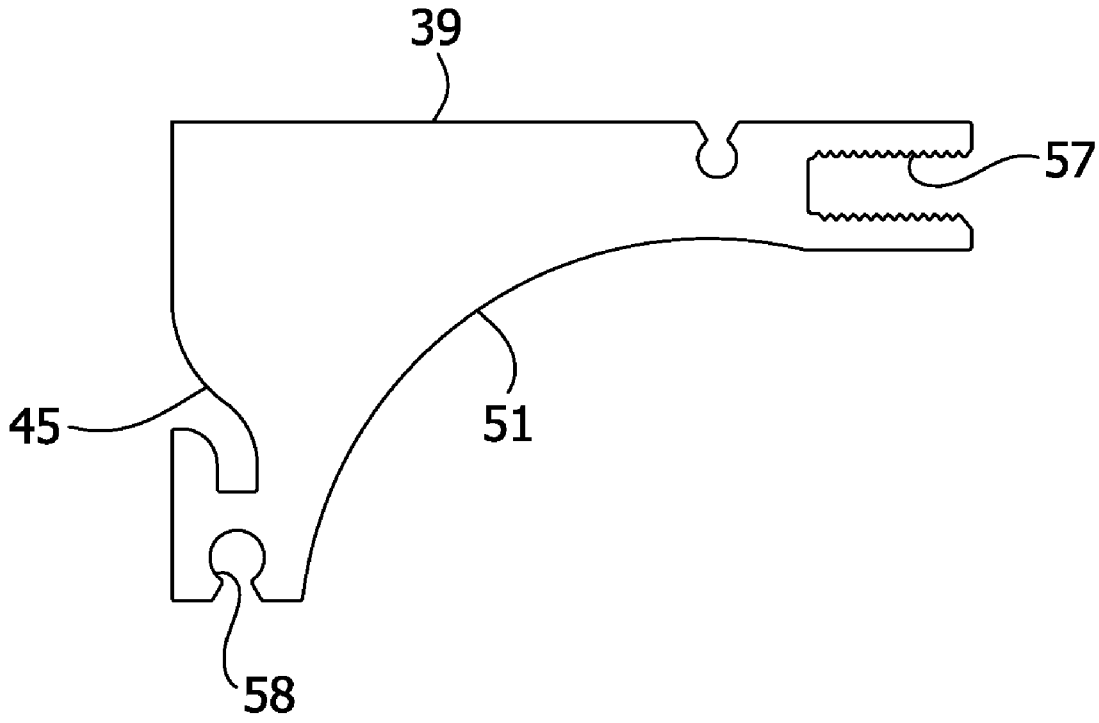
FIG. 7 is a side view of the heat conductor.

Referring to FIGS. 2-4, the motor drive 25 of this embodiment includes a generally rectangular housing 29 defined by a bottom panel 31, an opposing cover panel 33, two opposing sidewalls 35, an endwall 37, and an opposing wall forms a thermal or heat conductor 39 (alternatively referred to as a heatsink). The housing 29 is sized to receive the electrical components 41 and connectors 42 of the drive 25, some of which are mounted on printed circuit boards 43. One of the sidewalls 35 includes openings for receiving the connectors 42. As shown in FIGS. 5-7, the conductor 39 may include a groove 45 for receiving a tongue 47 of the bottom panel 31.

An outer surface 51 of the heat conductor 39 is concave for receiving the cylindrical outer surface of the pipe 24 (it has a round cross-section as shown, though other shapes may be used). In this embodiment, the outer surface of the conductor 39 extends only partway around, e.g., ⅓ of the way around, the outer surface of the pipe 24. However, it is contemplated to have the outer surface extend around more or less of the pipe 24. The radius of the outer surface 51 is matched to that of the pipe 24 to promote thermal transfer from the conductor 39 through the pipe to the liquid therein.

In this embodiment, the heat conductor 39 is secured to the pipe 24 by two clamps 55. The clamps 55 are suitably thin strips of material, e.g., of metal such as spring steel, and are bent to conform to the shape of the pipe 24. The heat conductor 39 includes two slots (upper 57 and lower 58) extending longitudinally of the conductor, and generally perpendicular to each other, each adapted to receive a portion of the clamps 55 or fasteners 61. It is understood that the terms "upper" and "lower" refer only to the orientation of the slots as depicted in the drawings and are not meant to be limiting in any way. The lower slot 58 has open ends and is sized and shaped to receive a hinge 63 of each clamp 55. The hinge 63 includes an enlarged portion or "hinge bend" that can be inserted into one of the ends of the lower slot 58 and slid partway along its length. The shape of the slot 58 (a "C" shape as shown) ensures that the clamp 55 cannot be pulled out of the slot except by sliding it to one of the ends. The other end of the clamp 55 includes a hole (not shown) for receiving the fastener 61 that passes therethrough and into the upper slot 57. During attachment of the drive 25 to the pipe 24, each clamp 55 is slid into the lower slot 58, extended over the pipe, and a fastener 61 is passed through the hole and into the upper slot 57. In this manner, the clamps 55 enable quick attachment of the drive 25 to the pipe 24.

It will be understood that other ways of attaching the drive 25 to the pipe 24 are contemplated. For example, the heat conductor 39 may be formed in two pieces, e.g., in a "saddle" shape, so that a first piece closer to the drive 25 is placed against the pipe 24, and the other piece is placed over the pipe opposite the first piece. Suitable fastening means are used to secure the two saddle pieces together. Such a configuration may allow for more heat conduction through the heat conductor 39.

The drive 25 includes a power module 71 and diodes 73, among other electrical components, that generate heat. In this embodiment, the power module 71 and diodes 73 are mounted directly on an inside surface of the heat conductor 39. Heat from the power module 71 and diodes 73 is conducted through the heat conductor 39 to the pipe 24. The heat is then conducted through the pipe 24 to water flowing therethrough. The heat conductor does not directly contact the water. The water is at a temperature significantly lower than that of the heat conductor 39 so that it cools the pipe, heat conductor and thereby cools the power module 71, diodes 73, and more generally, the drive 25. As can be seen, the heat-generating components are thermally connected to the pipe 24 and the liquid (e.g., water) therein.

The conductor 39 may be made of a variety of materials capable of conducting heat, such as extrudable aluminum or an aluminum alloy, among other materials. In one example, the conductor 39 is made of 6063-T5 aluminum. Also, the conductor may be made by extrusion, among other possible methods.

In one example, the drive 25 has an ambient operating temperature of about 180° F. (about 82° C.) and the water has a maximum temperature of about 105° F. (about 40° C.). The power module 71 generates about 100 W, while the diodes 73 generate about 20 W. The circulating water and the heat conduction through the conductor 39 is sufficient to maintain the drive 25 at its operating temperature and to prevent the drive temperature from climbing above its maximum temperature of about 150° C. Note the normal operating temperature is about negative 40° to about 80° C., and the water temperature is typically between about 1° and 40° C.

In most applications, the volume of water is such that the heat transfer from the drive 25 will have an insignificant effect on the water temperature. The cooling media (water) generally has a consistent maximum temperature so that it serves as a reliable coolant. The pool 11 may include an optional heater for maintaining the water at or around an adjustable or predetermined temperature. For smaller volumes of water, the heat from the pump system 13 may also advantageously reduce the heat input required from the heater.

Embodiments of the present invention enable a relatively small heat conductor 39 to be used, which is advantageous in the small space around many whirlpools. ("Whirlpool" includes tubs, spas, baths, and the like as noted above without limitation, and they may be installed inside or outside). Prior art systems would have required a large air-cooled surface area to dissipate the relatively large amount of heat generated by newer pump systems, and thereby taken up significant space around the whirlpool. Moreover, the large surface area adds weight and cost to the system. Such a large surface area may not be feasible for some whirlpools. Accordingly, embodiments of the present invention greatly reduce the space required for heat dissipation, as well as the weight and cost of the conductor 39. In one embodiment, the conductor 39 has a material volume of about 9 to 10 cubic inches, whereas the equivalent prior art air-cooled heatsink would be at least 13 cubic inches and require a fan to blow air over the heatsink. This heat would add to the ambient heat under the whirlpool. Elimination of such a fan is another advantage of embodiments of the invention, in that the system is quieter. The system is also more reliable in that there is no potential for fan failure or clogging.

Additionally, the heat conductor 39 may be advantageously mounted so as to be isolated from harmful chemicals in the water. The water may contain chemicals such as chlorine, bromine, ozone, pH modifiers, minerals, salts, soaps, oils, creams, and the like. The heat conductor 39 of one embodiment is not in direct contact with the water. Accordingly, these harmful chemicals will not damage the heat conductor 39.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A thermal conductor for a heat-generating liquid pump system of a pool containing liquid, the system including a pipe for conveying liquid pumped through the pump system, said pipe having a tubular exterior surface extending along a length of the pipe and around a cross-sectional perimeter of the pipe, the conductor comprising a body having a surface corresponding to the tubular exterior surface of the pipe so the surface of the body extends along the length of pipe and at least partially around the cross-sectional perimeter of the pipe, the body being in thermal communication with a heat generating portion of the pump system and in thermal communication with the exterior surface of the pipe without being in direct physical contact with liquid in the pipe.

2. The thermal conductor of claim 1 wherein the heat generating portion is a power module secured to a surface of the body.

3. The thermal conductor of claim 2 wherein the body is attached to a panel for mounting a plurality of electrical components.

4. The thermal conductor of claim 2 wherein the body forms a portion of a housing enclosing a plurality of electrical components.

5. The thermal conductor of claim 1 wherein the heat generating portion is a motor drive.

6. The thermal conductor of claim 1 in combination with the liquid pump system, the system being adapted to pump water.

7. The thermal conductor of claim 1 wherein the pipe has a round cross section, the body including a concave portion for receiving a portion of the pipe.

8. The thermal conductor of claim 7 further comprising a clamp for attaching the body to the pipe.

9. A thermal conductor for a heat-generating liquid pump system of a pool containing liquid, the system including a round pipe, the conductor adapted for conducting heat from the pump system to liquid circulated by the pump system, the conductor comprising:

a body in thermal communication with a heat generating portion of the pump system and in thermal communication with only an outside surface of the pipe and not in direct contact with the liquid, the body including a concave portion for receiving a portion of the pipe, and a clamp for attaching the body to the pipe, wherein the body includes slots for facilitating quick attachment of the body to the pipe.

10. The thermal conductor of claim 9 wherein the body is made of aluminum or an aluminum alloy.

11. A thermal conductor for a heat-generating liquid pump system of a pool containing liquid, the system including a pipe, the conductor adapted for conducting heat from the pump system to liquid circulated by the pump system, the conductor comprising a body in thermal communication with a heat generating portion of the pump system and in thermal communication with only an outside surface of the pipe and not in direct contact with the liquid, wherein the body includes a first slot for receiving a first end of the clamp and a second slot for receiving a fastener extending through a second end of the clamp, the clamp requiring only one fastener.

12. The thermal conductor of claim 11 wherein the body extends longitudinally along the pipe, the slots extending substantially the length of the body to facilitate placement of the fastener along the length of the body.

13. A pool for containing water, the pool comprising:

a pipe system connected to the pool including an inlet for receiving water from the pool and an outlet for delivering water into the pool, a pump system including a pump for circulating the water through the pipe system, a motor for driving the pump, heat-generating electronics operatively connected to the motor for controlling the motor, and a heat conductor for conducting heat from the electronics comprising a body in direct thermal communication with the electronics and pipe system for conveying heat from the electronics to water in the pipe system.

14. The pool of claim 13 wherein the heat conductor is not in direct contact with the water.

15. The pool of claim 14 wherein at least a portion of the pipe system is made of stainless steel, the heat conductor being in direct contact with the stainless steel.

16. The pool of claim 15 wherein the heat-generating electronics include a power module mounted on the heat conductor.

17. The pool of claim 16 wherein the heat conductor is made of aluminum or an aluminum alloy.

18. The pool of claim 13 wherein the pool is adapted to maintain the water below a predetermined maximum temperature.

19. A thermal conductor for a heat-generating liquid pump system of a pool containing liquid, the system including a pipe, the conductor comprising a body in thermal communication with and secured to a power module of the pump system and in thermal communication with an outside surface of the pipe and not in direct contact with liquid in the pipe.

20. The thermal conductor of claim 19 wherein the power module comprises a panel and a plurality of electrical components mounted on the panel, and the body is attached to the panel.

21. The thermal conductor of claim 19 wherein the power module comprises a plurality of electrical components and the body of the thermal conductor forms a portion of a housing enclosing said electrical components.

22. A thermal conductor for a heat-generating liquid pump system of a pool containing liquid, the system including a pump, a pipe connected to the pump, a motor driving the pump, and an electronic motor drive electrically connected to the motor and remote from the motor, the conductor comprising a body in thermal communication with the electronic motor drive and in thermal communication with an outside surface of the pipe.

23. A thermal conductor for a heat-generating liquid pump system of a pool containing liquid, the system comprising a pipe and a pump operable to circulate the liquid through the pipe, the pipe extending from the pump to the pool, the thermal conductor comprising a body in thermal communication with a heat generating portion of the pump system and in thermal communication with an outside surface of the pipe.

* * * * *

UNITED STATES PATENT AND TRADEMARK OFFICE

CERTIFICATE OF CORRECTION

PATENT NO. : 7,638,741 B2
APPLICATION NO. : 11/420598
DATED : December 29, 2009
INVENTOR(S) : Morgan et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 439 days.

Signed and Sealed this

Ninth Day of November, 2010

David J. Kappos

David J. Kappos
*Director of the United States Patent and Trademark Office*